US006604493B1

(12) United States Patent
Toki

(10) Patent No.: US 6,604,493 B1
(45) Date of Patent: Aug. 12, 2003

(54) LIQUID MATERIAL VAPORIZING AND FEEDING APPARATUS

(75) Inventor: Ikuo Toki, Tokyo (JP)

(73) Assignee: Aera Japan Ltd., Tokyo (JP)

( * ) Notice: Subject to any disclaimer, the term of this patent is extended or adjusted under 35 U.S.C. 154(b) by 0 days.

(21) Appl. No.: 10/266,815

(22) Filed: Oct. 8, 2002

(30) Foreign Application Priority Data

Jun. 3, 2002 (JP) ..... 2002-161316

(51) Int. Cl.[7] ..... F22B 27/00
(52) U.S. Cl. ..... 122/40; 122/208; 392/399
(58) Field of Search ..... 122/39, 40, 208; 392/467, 386, 396, 399; 126/299 E, 271.1

(56) References Cited

U.S. PATENT DOCUMENTS 1,226,849 A * 5/1917 Bookman ..... 122/4 A
5,215,043 A * 6/1993 Tsutsumi ..... 122/39
5,224,202 A * 6/1993 Arnold et al. ..... 392/399

FOREIGN PATENT DOCUMENTS

JP 6-256036 A 9/1994
JP 2001-156055 A 6/2001

* cited by examiner

*Primary Examiner*—Gregory Wilson
(74) *Attorney, Agent, or Firm*—Howson and Howson

(57) ABSTRACT

A liquid vaporizing and feeding apparatus, having high heat transfer efficiency and capable of producing a large flow of vaporized gas from a small amount of liquid, utilizes an inclined vaporization plate which is held at a set temperature by a heater. Liquid, discharged by a nozzle in the vicinity of the upper end of the vaporization plate, is vaporized as it flows down an inclined upper face of the vaporization plate. When the volume of the liquid collected on the vaporization plate 20 reaches a designated amount, a level sensor 40 stops the inflow of liquid through the nozzle. Then, as vaporization continues, and the liquid level falls, the sensor causes inflow of liquid to resume. The cycle of stopping and resuming flow of liquid is repeated to maintain a constant liquid level.

9 Claims, 4 Drawing Sheets

LIQUID MATERIAL VAPORIZING AND FEEDING APPARATUS

FIELD OF THE INVENTION

This invention relates to the vaporization of liquids and to an apparatus for feeding a special gas, produced by the vaporization of a liquid, to a semiconductor manufacturing line or the like.

BACKGROUND OF THE INVENTION

There are two principal kinds of conventional liquid vaporizing and feeding apparatus. In one such apparatus, a vaporizer, in which a vaporizing portion is built into a control valve, is combined with a flow meter for liquid or a flow meter for gas. In another such apparatus, a vaporization container is combined with a sensor for responding to the amount of liquid, a liquid temperature controller, a gas flow controller, conduits for the inflow and outflow of liquid, and an open-and-shut valve. These components are all located in a temperature-controlled container.

A vaporizing and feeding apparatus which vaporizes liquid in a liquid container is not subject to the problems of pyrolysis of the liquid and foaming in the container, since the apparatus is heated from the outside of the container, and the liquid is present in the container in the form of a pool. However, since the container wall, which is typically made of stainless steel or the like, is situated between the heater and the liquid, the apparatus has a low vaporization efficiency.

A vaporizer in which a vaporizing portion is built into a control valve is disclosed in Japanese Unexamined Patent Publication No. 156055/2001. This apparatus improves vaporization efficiency by providing a uniquely shaped mixing portion for liquid and carrier gas.

Although not used for semiconductor manufacture, an apparatus which vaporizes and feeds liquid raw materials for glass is disclosed in Japanese Unexamined Patent Publication No. 256036/1994. This liquid material vaporizing and feeding apparatus improves vaporization efficiency by providing convexities and concavities inside a vaporization container, thereby increasing the heating area.

The vaporizer of Japanese Unexamined Patent Publication No. 156055/2001, in which the control valve has a vaporization function, is small in size. However, particles and contamination are generated in the vaporizer, since liquid materials are readily decomposed by partial heating. This vaporizer has other problems, in that its ability to vaporize liquid deteriorates, and proper control is not achieved because of foaming taking place in the liquid within the container.

Although the vaporization apparatus of Japanese Unexamined Patent Publication No. 256036/1994, has high vaporization stability, the apparatus itself is large, and the amount of liquid in its tank is also large. Therefore, since the space required for its installation is large, the apparatus cannot easily be built into semiconductor manufacturing equipment. Moreover, since the amount of liquid utilized in the apparatus is large, and liquid exchange is required for maintenance, the cost of the expensive liquid materials required for maintenance is high, and a large amount of time is required for removal of liquid when the maintenance is carried out.

SUMMARY OF THE INVENTION

A liquid vaporizing and feeding apparatus in accordance with the invention, which addresses the aforementioned problems, comprises a vaporization container and a vaporization plate within the container, preferably located at the bottom of the container. The plate is inclined relative to the horizontal. Means are provided for heating the vaporization plate, and means are provided for feeding liquid onto the vaporization plate adjacent the upper end thereof.

A liquid level detection means is responsive to the level of liquid collected on the vaporization plate, and means responsive to the liquid level detection means controls the feed of liquid onto the vaporization plate by the feeding means.

The liquid level detection means includes a capillary tube, a lower end of which is arranged to be contacted by the surface of the liquid collected on the vaporization plate when the volume of liquid reaches a desired volume. The capillary tube is associated with a thermal sensor, and provides liquid level detection with a high degree of sensitivity.

The flow of vaporized gas produced by the vaporizing and feeding apparatus is controlled by a mass flow controller, which, in a preferred embodiment, is a pressure type mass flow controller.

In the invention, since the vaporization plate is held at a certain temperature which is in accordance with the vaporizing condition of liquid materials, the influence of pyrolysis of liquid materials may be reduced and relatively large amount of vaporization flow may be obtained with a small vaporization area.

Even if the amount of liquid introduced into the vaporization container is not large, adequate vaporization flow may be obtained by inclining the vaporization plate relative to the horizontal. Therefore, the apparatus can be miniaturized, and the time and cost of maintenance, which requires liquid exchange, can be decreased.

BRIEF DESCRIPTION OF THE DRAWINGS

FIG. 3(*b*) is a cross-sectional view of the liquid feed portion of FIG. 3(*a*), illustrating how the influence of surface tension in liquid discharged from the nozzle is weakened;

DETAILED DESCRIPTION OF THE PREFERRED EMBODIMENTS

Figure 1:
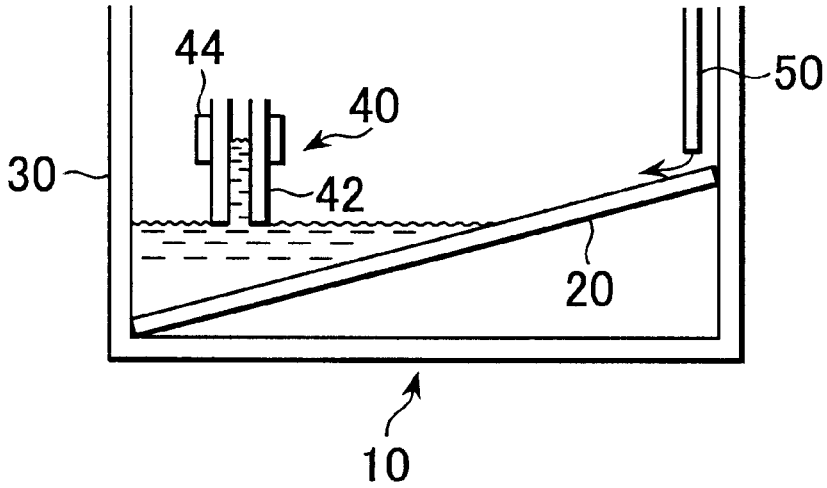
FIG. 1 is a schematic cross-sectional view which illustrates the structure of a liquid material vaporizing and feeding apparatus according to the invention.

The liquid material vaporizing and feeding apparatus 10, as shown in FIG. 1, comprises a vaporization plate 20, a vaporization container 30, a liquid level sensor 40, and one or more nozzles 50, which serve as liquid feed means. The vaporization plate 20 is located at the bottom of the vaporization container 30, and its upper surface, which is preferably planar, is inclined relative to the horizontal. The vaporization plate is held at a certain temperature by a heating means (not shown). It is desirable that the angle of inclination be in the range of 2 to 5°, preferably 3°. The temperature of the vaporization plate is set according to the physical and chemical properties, and the vaporizing condition of, the liquid that is fed to the vaporization plate through the nozzles 50.

The nozzles 50 are provided in the vicinity of the upper end of the vaporization plate 20, and a plurality of nozzles is preferred so that the vaporization area is increased.

When operation starts, liquid is discharged from the nozzles 50, and flows down the inclined surface of the vaporization plate 20. As the liquid flows down the inclined surface, it is vaporized. The instantaneous rate at which liquid is fed to the plate through the nozzles is set to be greater than the rate at which the liquid vaporizes. Consequently, the liquid level rises gradually after the operation starts.

When the volume of liquid in the vaporization container 30 reaches a prescribed amount, a liquid level sensor 40 sends a signal causing the inflow of liquid through the nozzles 50 to stop.

As vaporization continues, and the liquid level falls, the liquid level sensor 40 causes inflow of liquid to resume. The liquid level sensor, and the liquid flow controlling apparatus that responds to the sensor signals, cycle repeatedly, and maintain the volume of the liquid collected on the vaporization plate within a prescribed narrow range.

The liquid level sensor 40 comprises a tube 42, and a heat sensor 44 which is attached to the tube 42. When the liquid rises to a level such that the lower end of the tube 42 touches the liquid surface, liquid rises in the tube as a result of the capillary phenomenon. The liquid level sensor 40 can be made smaller than a conventional float-type liquid level sensor, and therefore allows the liquid material vaporizing and feeding apparatus to be miniaturized. Moreover, the sensor is capable of detecting the liquid level with greater sensitivity than conventional float-type liquid level sensor.

Figure 2:
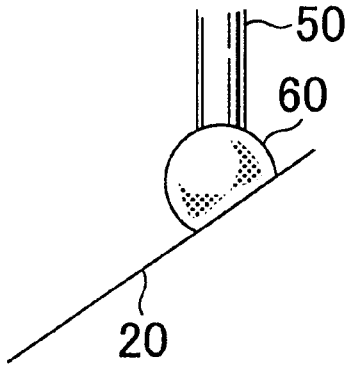
FIG. 2 is an enlarged schematic view illustrating in detail the manner in which a drop of liquid discharged from a nozzle becomes round as a result of surface tension.

FIG. 2 illustrates how, when the surface of the vaporization plate 20 is a mirror finished surface, a drop of liquid 60 being discharged from a nozzle 50 becomes round as a result of surface tension. The effect of surface tension, as illustrated in FIG. 2, impairs the spread of the flow of liquid. Accordingly, measures may be taken to weaken the influence of surface tension on the shape of the liquid drops discharged from the nozzles.

One way in which to weaken the effect of surface tension is to make the surface of the vaporization plate 20 a scratch-brush finished surface.

Figure 3A:
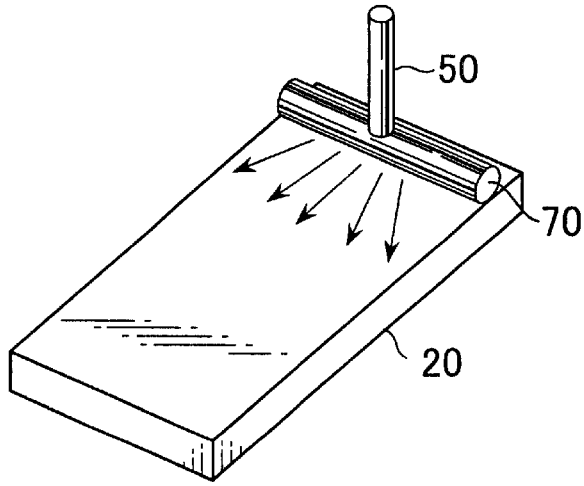
FIG. 3(*a*) is a schematic view of the liquid feed portion of a liquid material vaporizing and feeding apparatus according to the invention.
Figure 3B:
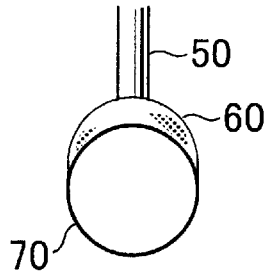

FIG. 3(*a*) illustrates another measure for weakening the influence of surface tension. In liquid feed portion of the apparatus, a round bar 70 is provided on the upper part of the vaporization plate 20, and the opening of the nozzle 50 is positioned at a very short distance from the round bar. As shown in FIG. 3(*b*), the liquid 60 moves from the nozzle 50 to the round bar 70, the influence of the surface tension of the liquid 60 is weakened by the round bar 70, and the flow and spread of the liquid 60 are improved as a result.

Figure 4:
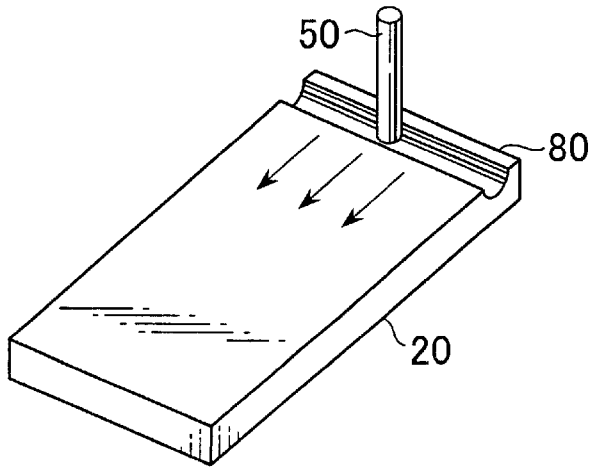
FIG. 4 is schematic view of the liquid feed portion of a liquid material vaporizing and feeding apparatus according to a further embodiment of the invention.

FIG. 4 illustrates still another measure for weakening the influence of surface tension. In this case, in the liquid feed portion of the apparatus, an elongated recess 80 is provided in the upper part of vaporization plate 20. As in the case of the round bar of FIG. 3(*a*), the elongated recess 80 weakens the effect of surface tension and improves the flow and spread of the liquid.

Other measures for weakening the influence of surface tension and improving the flow and spread of the liquid, include the attachment of a-mesh to the surface of the plate by adhesive or other suitable means, or etching of the surface of the plate. Experiments have established that vaporization efficiency can be improved by about 20% by providing a mesh on the plate.

Figure 5:
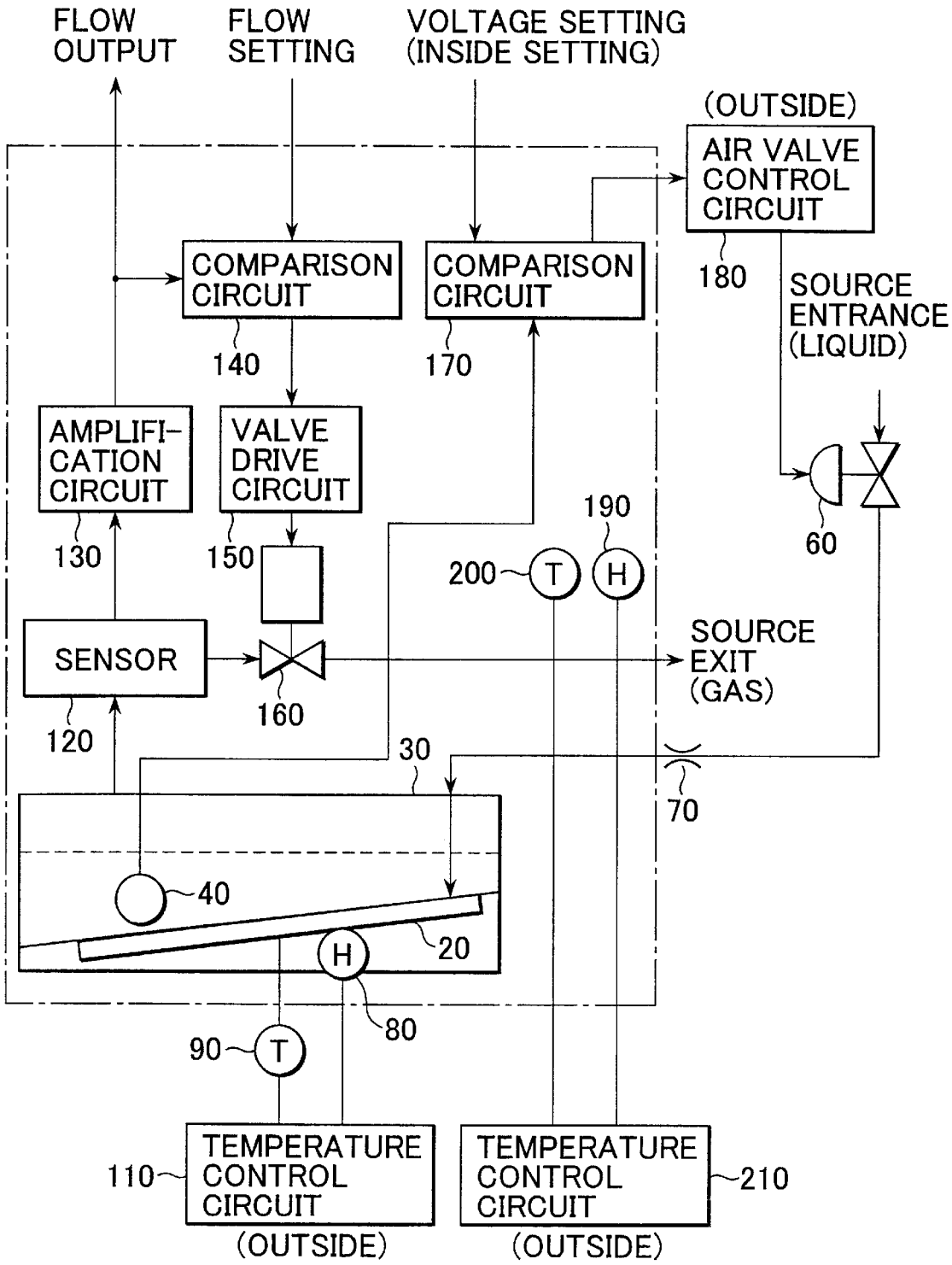
FIG. 5 is a block diagram which illustrates a liquid material vaporizing and feeding apparatus according to an embodiment of the invention in which a thermal type mass flow controller is used as a flow control means for vaporized gas.

In the thermal type mass flow controller shown in FIG. 5, the feed of liquid from a source entrance is controlled by opening and shutting an air-operated valve 60. When the air-operated valve 60 is opened, liquid flows through a feed conduit into a vaporization container 30. The amount of fed liquid is limited by providing a limiting device 70 either at the end or at an intermediate location along the feed conduit. An orifice, a nozzle, or the like are preferred as limiting devices. Alternatively, a mass flow controller can be used for controlling the flow of liquid through the feed conduit. However, the use of a mass flow controller for this purpose is expensive.

Liquid in the vaporization container 30 flows down the inclined surface of a vaporization plate 20, which is heated by a heater 80, such as an electrothermal heater, a heat pipe, or the like. The temperature of the vaporization plate 20 is detected by a temperature sensor 90, and a temperature control circuit 110, responsive to the temperature sensor 90, controls the heater 80 to maintain the temperature of the vaporization plate at a constant level.

The liquid level in the vaporization container 30 is detected by a liquid level sensor 40, and a detection signal is transmitted to a comparison circuit 170, which compares the voltage of the detection signal with an independently set voltage. An air valve make-and-break circuit 180 is driven by the output of the comparison circuit to open and shut the air-operated valve 60.

A sensor 120, which is preferably a thermal sensor, detects the flow of vaporized gas. The signal delivered by the thermal sensor is amplified by an amplification circuit 130. The output of the amplification circuit is read as an indication of the flow of vaporized gas. It is also compared with a set value for vaporized gas flow by a comparison circuit 140. A valve drive circuit 150 is operated by an output signal from the comparison circuit 140, and the delivery of vaporized gas is controlled by the valve 160 so that the flow of gas corresponds to the set value.

The overall temperature of the apparatus is regulated by a temperature sensor 200, a temperature control circuit 210, which is responsive to the sensor 200, and a heater 190, which is responsive to an output of the control circuit.

Space is provided inside the vaporization container so that reliquefaction of the vaporized liquid, and rapid vaporization of liquid which adheres to the sidewalls of the vaporization container, can be prevented. Although it is desirable that the space be defined by a partition wall in the vaporization container 30, a partition is unnecessary, provided that the capacity of the vaporization container 30 is sufficiently large.

Figure 6:
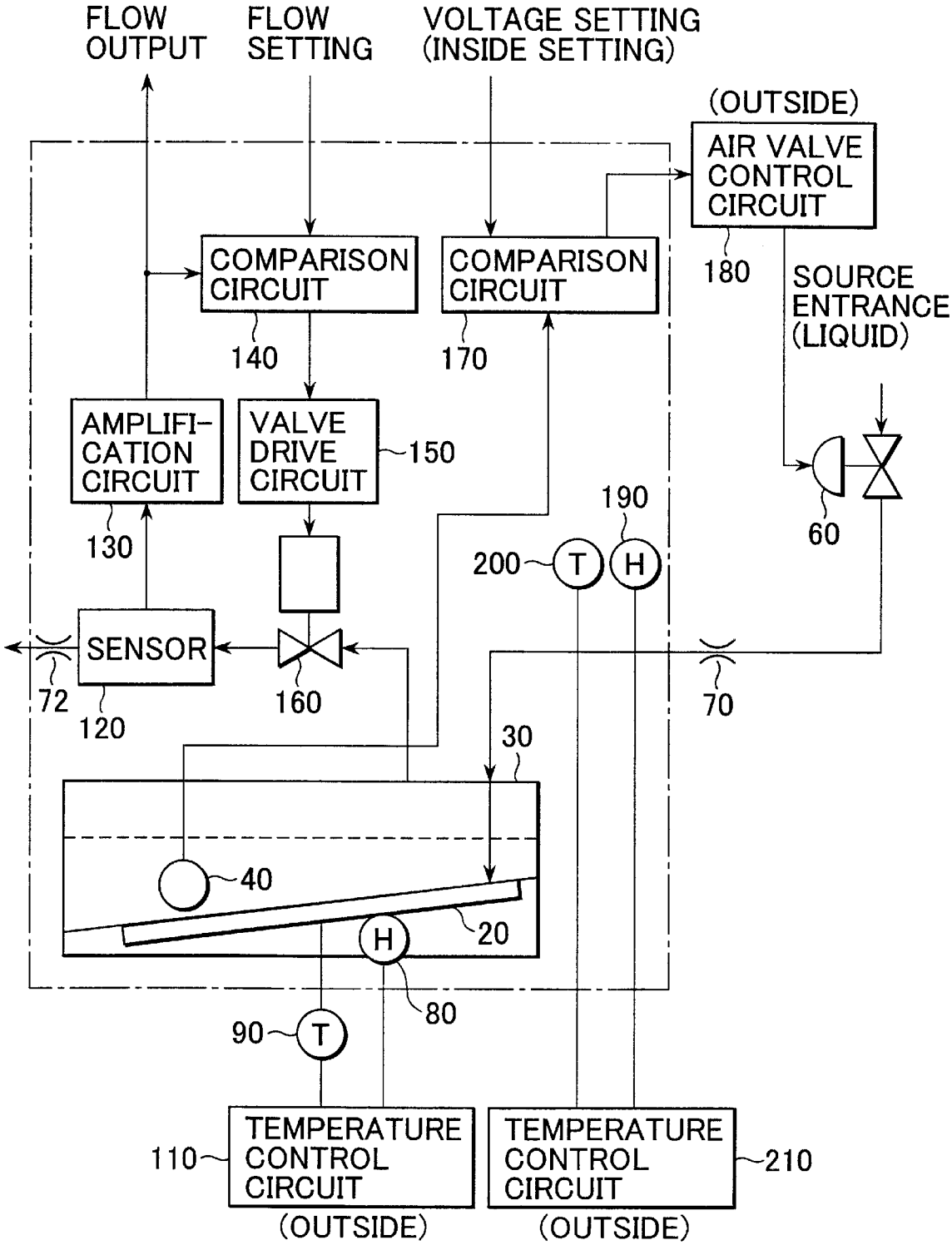
FIG. 6 is a block diagram which illustrates a liquid material vaporizing and feeding apparatus according to an embodiment of the invention in which a pressure type mass flow controller is used as a flow control means for vaporized gas.

In the pressure type mass flow controller of FIG. 6, as in FIG. 5, a liquid level sensor 40 is connected to a comparison circuit 170, and an air valve 60 is opened and shut. On the other hand, sensor 120' is a pressure sensor, which is arranged to respond to pressure on the upstream side of a nozzle or orifice 72. The pressure controlled by a control valve 160', which is provided upstream of the pressure sensor 120'. Thus the flow of vaporized gas through the nozzle or orifice 72 is controlled by maintaining a constant pressure upstream of the nozzle or orifice 74 Since the pressure sensor output is amplified and transformed and in effect becomes an output corresponding to flow, the operation of the pressure-type mass flow controller of FIG. 6 in response to a flow setting, is similar to that of the thermal type mass flow controller of FIG. 5.

In still another variation (not illustrated) pressure sensors can be provide both on the upstream side and on the downstream side of the nozzle or orifice 72, in which case the flow of (vaporized gas is controlled in accordance with a flow output derived from the pressure drop across the nozzle or orifice.

Other features of the pressure-type mass flow controller of FIG. 6 are the same as those of the thermal mass flow controller of FIG. 5.

The liquid vaporizing and feeding apparatus according to the invention reduces the influence of pyrolysis of the liquid, and achieves improved vaporization efficiency, since the vaporization plate is held at a temperature appropriate for the vaporization of the particular liquid which is used.

Moreover, since the inclination of the vaporization plate results in adequate vaporization flow even when relatively small amounts of liquid are flowing into the vaporization container, the apparatus can be miniaturized, and the cost and time required for maintenance can be reduced.

What is claimed is:

1. A liquid vaporizing and feeding apparatus comprising:

a vaporization container;

a vaporization plate within the container, the plate being inclined relative to the horizontal;

means for heating the vaporization plate;

means for feeding liquid onto the vaporization plate adjacent the upper end thereof;

liquid level detection means responsive to the level of liquid collected on said vaporization plate; and means responsive to said liquid level detection means for controlling the feed of liquid onto the vaporization plate by said feeding means.

2. A liquid vaporizing and feeding apparatus according to claim 1 in which the plate is located at the bottom of the vaporization container.

3. A liquid vaporizing and feeding apparatus according to claim 1 in which the liquid level detection means produces a signal, and in which the means responsive to the liquid level detection means receives and responds to said signal.

4. A liquid vaporizing and feeding apparatus according to claim 1 in which the liquid level detection means produces a signal, and in which the means responsive to the liquid level detection means receives and responds to said signal to maintain the level of the liquid collected on the vaporization plate within a limited range.

5. A liquid vaporizing and feeding apparatus according to claim 1, including a mass flow controller for controlling the flow of vaporized gas.

6. A liquid vaporizing and feeding apparatus according to claim 1 including a pressure type mass flow controller for controlling the flow of vaporized gas.

7. A liquid vaporizing and feeding apparatus according to claim 1, in which said liquid level detection means includes a capillary tube.

8. A liquid vaporizing apparatus according to claim 7, including a mass flow controller for controlling the flow of vaporized gas.

9. A liquid material feeder according to claim 7, including a pressure type mass flow controller for controlling the flow of vaporized gas.

* * * * *